US006966475B2

(12) United States Patent
Zweifel et al.

(10) Patent No.: US 6,966,475 B2
(45) Date of Patent: Nov. 22, 2005

(54) DRAW ROLLER WITH ADJUSTABLE PULL RING

(75) Inventors: Hans Zweifel, Boll (CH); Thomas Treuthard, Wohlen (CH)

(73) Assignee: Maschinenfabrik WIFAG, Bern (CH)

( * ) Notice: Subject to any disclaimer, the term of this patent is extended or adjusted under 35 U.S.C. 154(b) by 126 days.

(21) Appl. No.: 10/609,511

(22) Filed: Jun. 30, 2003

(65) Prior Publication Data

US 2004/0050895 A1 Mar. 18, 2004

(30) Foreign Application Priority Data

Jul. 1, 2002 (DE) ..... 102 29 457

(51) Int. Cl.[7] ..... B65H 20/02; B41L 43/04
(52) U.S. Cl. ..... 226/179; 270/41
(58) Field of Search ..... 226/179; 270/40, 270/41; 493/439, 440

(56) References Cited

U.S. PATENT DOCUMENTS

| | | | | |
|---|---|---|---|---|
| 2,458,346 A | * | 1/1949 | Charlin | 226/179 |
| 2,799,498 A | * | 7/1957 | Richards | 226/179 |
| 2,871,011 A | * | 1/1959 | Hercik | 226/179 |
| 4,482,148 A | * | 11/1984 | Stewart | 226/179 |
| 4,643,013 A | * | 2/1987 | Blazevic | 226/179 |
| 4,762,311 A | * | 8/1988 | Hertrich | 226/179 |
| 5,692,441 A | | 12/1997 | Michalik | |

FOREIGN PATENT DOCUMENTS

DE 195 37 422 4/1997

* cited by examiner

*Primary Examiner*—John M. Jillions
(74) *Attorney, Agent, or Firm*—McGlew and Tuttle, P.C.

(57) ABSTRACT

A draw roller for pulling web-shaped material with at least one pull ring arranged on at least one part of the circumference of the roller. The at least one pull ring can be displaced on the draw roller.

15 Claims, 4 Drawing Sheets

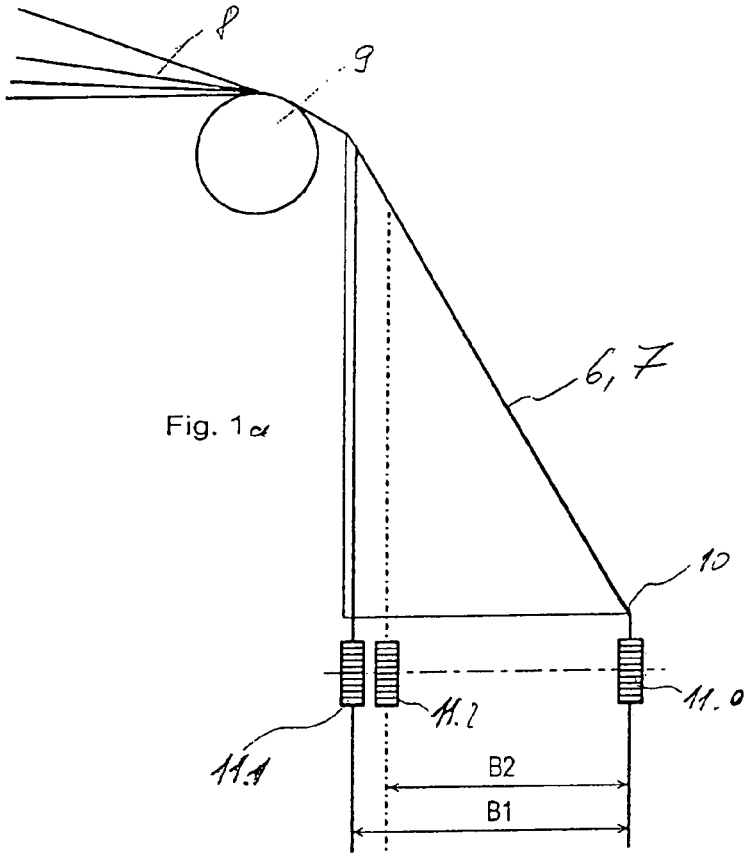
Fig. 1a
Fig. 1b
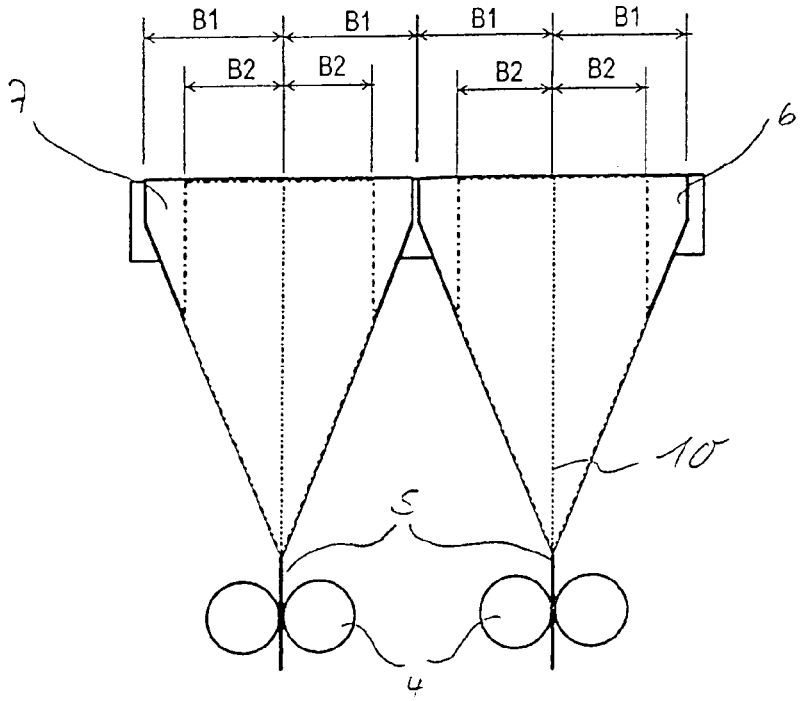

DRAW ROLLER WITH ADJUSTABLE PULL RING

FIELD OF THE INVENTION

The present invention pertains to a draw roller for pulling or conveying web-shaped material, which can be used, e.g., in rotary printing presses for printing newspapers or for producing job-like printed products.

BACKGROUND OF THE INVENTION

Draw rollers, whose pull rings arranged laterally are to run in the unprinted margin area of the web, are used to convey a web, e.g., a printed paper web in a folder of a rotary printing press. Two rollers coupled by a drive with two pull rings each, which are in functional connection with one another in pairs and ensure the pulling of the web and consequently the conveying of the web by a rotary movement, are usually provided.

If webs of different widths, e.g., different paper widths for different formats of printed products, are to be used, the draw roller with the pull rings arranged thereon must be adapted correspondingly.

A roller with pull rings is known from EP 0 140 015 A2, where a set of semicylindrical inserts is removed and replaced with another set of semicylindrical inserts, at which the pull rings are arranged in different positions to change the position of a pull ring. The clamped inserts must be removed for this purpose from the jacket surface of the draw roller and new inserts must be clamped. According to EP 0 140 015 A2, the time hitherto needed for correspondingly changing the roller can thus be reduced from about one day to about 15 minutes.

SUMMARY OF THE INVENTION

One object of the present invention is to propose a draw roller for pulling web-shaped material with pull rings, which can be adapted to different web widths rapidly and in a simple manner.

The draw roller according to the present invention is advantageously an approximately cylindrical body and can be used to pull web-shaped material. At least one and preferably two or more pull rings, which can come into contact with the web to be conveyed, are arranged on part of the circumference of the roller. The pull rings are frequently positioned on the draw roller such that these can run in an unprinted and, e.g., white margin area of a web to be conveyed. According to the present invention, at least one pull ring is arranged on the draw roller such that it can be displaced on the draw roller on the surface preferably in the axial direction of the draw roller. A pull ring arranged on at least part of the circumference of the draw roller can be held according to the present invention on the draw roller, e.g., via a bearing arranged on an adjusting element and secured against rotation in relation to the roller, e.g., by a groove or other suitable elements, so that a rotary movement of the draw roller can be converted into a rotation of the pull ring lying on the draw roller and can be transmitted, e.g., to a web that is in contact with the pull ring. The pull ring can be displaced according to the present invention preferably in the axial direction of the draw roller, without elements of the draw roller itself having to be replaced.

Two, three, four or more pull rings are advantageously arranged on one draw roller, and at least one pull ring can be adjusted, i.e., it can be displaced, e.g., in the axial direction on the draw roller. Two or even all pull rings may be advantageously arranged on the draw roller such that these can be adjusted or displaced. In general, both displaceably mounted or adjustable and non-adjustable pull rings and, e.g., pull rings fixed stationarily on the roller may be arranged on one draw roller.

The positioning or changing of the position of the at least one pull ring arranged adjustably on the draw roller may be advantageously performed by means of an adjusting device acting on the draw roller from the outside. For example, the adjusting device may have a threaded spindle, which is preferably arranged with its axis extending in parallel to the axis of rotation of the draw roller, so that a pull ring arranged on the draw roller can be displaced on the draw roller directly or indirectly, e.g., with the use of displaceable elements or sleeves and bearing, by rotating the threaded spindle, which preferably cooperates with a displaceable thread or a screw connection. A motor arranged in or outside the draw roller or an element which can be actuated manually, e.g., a handwheel, may be provided for driving the threaded spindle, so that at least one or more pull rings arranged on the draw roller can be displaced individually or together in the same direction or in opposite directions by a rotary movement generated by the motor or handwheel.

Furthermore, it is possible to change the position of a pull ring by a direct displacing movement. For example, a bar may be connected to the pull ring arranged on the draw roller directly or indirectly, e.g., via a sleeve and bearing, so that a displacement of the bar can be converted into a displacement of the pull ring, which is preferably mounted on the draw roller in such a manner that it is secured against rotation. For example, a hydraulic or pneumatic device, e.g., a pneumatic piston, an element which can be actuated manually, or a means acting on the bar, e.g., an electromagnetic means, e.g., a motor or an electromagnet, may be used to displace the bar.

According to preferred embodiments, the at least one displaceable pull ring arranged on the draw roller may consequently be displaced on the draw roller both by means of a rotating element, e.g., a threaded spindle, and/or by means of a displacing element, e.g., a displaceable bar, so that it is no longer necessary to perform mechanical work on the draw roller itself in order to change the position of a pull ring on the draw roller, i.e., for example, to displace the pull ring in the axial direction of the draw roller.

A measuring and/or display element, e.g., a position display for displaying the position of the pull ring on the roller, with which the determined position of a pull ring on the draw roller can be displayed and measured and used, e.g., for automatically setting the position, may be advantageously provided on the roller at or outside the range of action of the draw roller.

According to another aspect, the present invention pertains to a system with at least two rollers, wherein at least one of the preferably two rollers has at least one pull ring, which is arranged, as was described above, adjustably on the roller.

The rollers are preferably provided in pairs and are, e.g., in functional connection, so that, e.g., by pivoting a roller, the rollers can be brought into a position in which the central axes or axes of rotation of the rollers are approximately parallel to each other and a web can be guided between the rollers and/or the pull rings.

One or both rollers may be mounted stationarily and/or pivotably, so that the web can be guided and conveyed, e.g., between a non-pivotable draw roller and a draw roller that can be pivoted toward the non-pivotable roller.

A drive may be advantageously provided for driving at least one draw roller and preferably for driving two or more draw rollers, so that the draw rollers can be driven synchronously with one another in order to ensure the reliable conveying or a defined tension of the web being guided between the draw rollers.

The draw roller with at least one pull ring adjustable according to the present invention is advantageously used in the printing industry, e.g., to convey a paper web at a former.

According to another aspect, the present invention pertains to a process for adapting a draw roller to different conditions of use, especially to adjust the position of at least one pull ring on a draw roller, wherein the pull ring is displaced directly on the draw roller, preferably on the surface and in the axial direction of the draw roller.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 1*a* is a schematic view of the position of pull rings mounted on a draw roller for guiding paper webs of different widths, which are fed to a former;

FIG. 1*b* is a side view of the arrangement shown in FIG. 1*a;*

DESCRIPTION OF THE PREFERRED EMBODIMENTS

Figure 2:
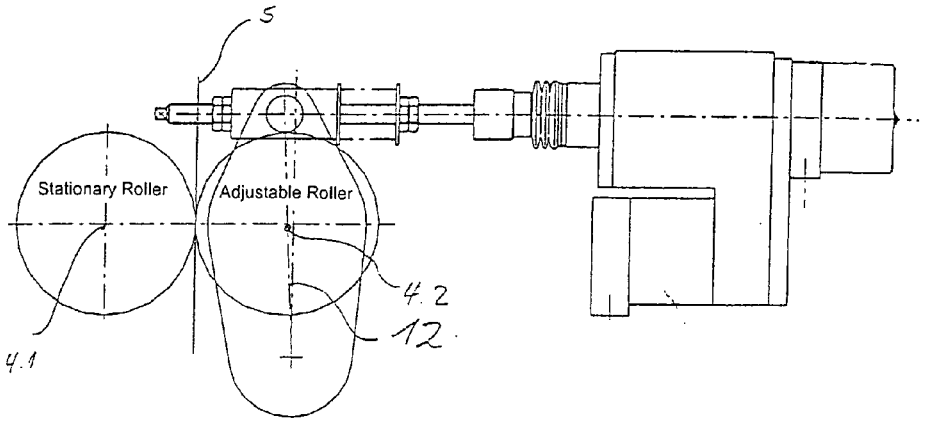
FIG. 2 is a view showing a possible arrangement of two draw rollers for guiding a web.

Referring to the drawings in particular, FIGS. 1*a* and 1*b* show two formers 6 and 7, to which one or more paper webs 8 are fed. The paper webs 8 are first guided over a forming roller 9 before they come to lie on the respective formers 6, 7 and the longitudinal fold indicated by broken line in FIG. 1*b* is formed over the respective former 6 or 7 at the site of the tip 10 of the former. The longitudinally folded endless paper webs 8 form a so-called bundle 5 after the formers 6, 7. As is shown in FIG. 1*b*, the paper webs 8 preferably always run centrally on the tip 10 of the former when a fold is to be produced in the center of the paper web. If a paper web has a width of 2×B1, the right-hand pull ring of the draw roller (not shown) is arranged at position 11.0 in the right-hand margin area of the paper web 8 in the embodiment shown in FIG. 1*a*, whereas the left-hand pull ring is arranged in the position designated by 11.1, so that both pull rings 11.0 and 11.1 can run in the unprinted margin area of the folded half web. However, if a paper web 8 with a smaller width of 2×B2 is fed to a former 6, 7, the left-hand pull ring must be displaced from position 11.1 to position 11.2 in order to be able to guide the web in the unprinted margin area. The pull ring arranged in position 11.0 remains, e.g., in the same position at the tip 10 of the former.

As can be seen in FIG. 1*b*, the draw rollers 4, on which the pull rings are arranged, are arranged after the respective formers 6 and 7.

FIG. 2 shows an embodiment with a draw roller 4.1 mounted stationarily, e.g., in the walls of a printing press or folding device and with an adjustable draw roller 4.2, which is mounted at a swivel arm 12 and can be displaced toward the draw roller 4.1. Both draw rollers 4.1 and 4.2 may be coupled with a drive, e.g., via a gear mechanism or by means of a toothed belt and be in functional connection.

Figure 3:
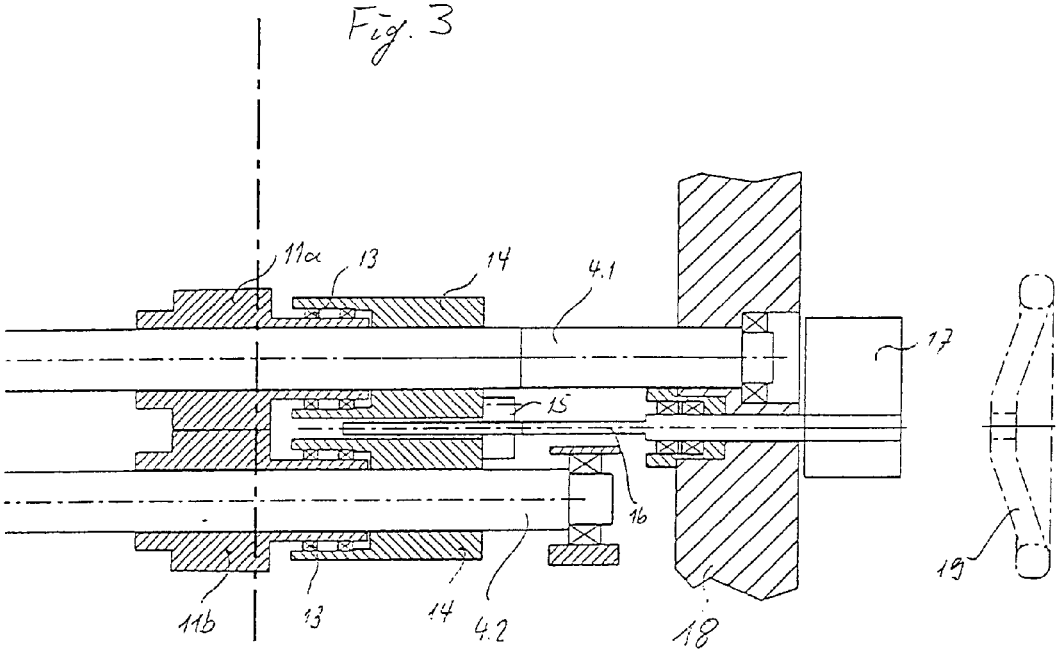
FIG. 3 is a draw roller, which is adjustable with a threaded spindle and is mounted on a draw roller.

As is shown in FIG. 3, at least one pull ring 11 is mounted nonrotatably and axially displaceably on one or both draw rollers 4.1 and 4.2. A threaded spindle 16 is mounted rotatably and stationarily in a wall 18 and is screwed into a threaded sleeve 15. A gear motor 17 is connected to the threaded spindle 16 and is arranged, e.g., likewise at the wall 18. A rotary movement acting on the threaded spindle 16 can be generated with the gear motor 17. Via the displaceable threaded sleeve 15, which is mounted in such a way that it is secured against rotation, and the axially displaceable sleeves 14, which are connected to the threaded sleeve 15 and surround the draw rollers 4.1 and 4.2, the threaded spindle 16 holds the rolling bearings 13 arranged on the sleeves 14 and the pull rings 11*a* and 11*b* connected to the bearings 13 on the respective draw rollers 4.1 and 4.2 in the position shown in FIG. 3.

The pull rings 11*a* and 11*b* are thus mounted axially displaceably on the rollers 4.1 and 4.2 but nonrotatably in relation to the respective draw rollers 4.1 and 4.2, i.e., rotation of the draw rollers 4.1 and 4.2 is transmitted to the respective pull rings 11*a* and 11*b* arranged on them.

If the position of the pull rings 11*a* and 11*b* on the draw rollers 4.1 and 4.2 is to be changed, the threaded sleeve 15, which is mounted on the threaded spindle 16 and engages the thread, can be displaced in the axial direction of the draw rollers 4.1 and 4.2 by a rotary movement transmitted from the gear motor 17 to the threaded spindle 16. The threaded sleeve 15 is rigidly connected to the axially displaceable sleeves 14 and transmits an axial displacing movement to the sleeves 14, from which a displacing movement can be transmitted to the respective pull rings 11*a* and 11*b* via the rolling bearings 13, so that the pull rings 11*a* and 11*b* can be displaced along the axial direction of the respective draw rollers 4.1 and 4.2.

Thus, the position of a pull ring 11*a* or 11*b* arranged on a draw roller 4.1 or 4.2 can be adjusted automatically by a simple actuation of the gear motor 17, e.g., during a change in production, without replacement and mounting operations having to be performed on the draw roller.

Instead of the motor 17, a handwheel 19 (indicated by broken line) may also be provided, so that the position(s) of the pull rings 11*a* and 11*b* can also be changed outside the range of action of the draw rollers 4.1 and 4.2. A position display may be advantageously provided in this case, so that the pull rings 11*a* and 11*b* can be positioned accurately in the desired positions on the respective draw rollers 4.1 and 4.2.

Figure 4:
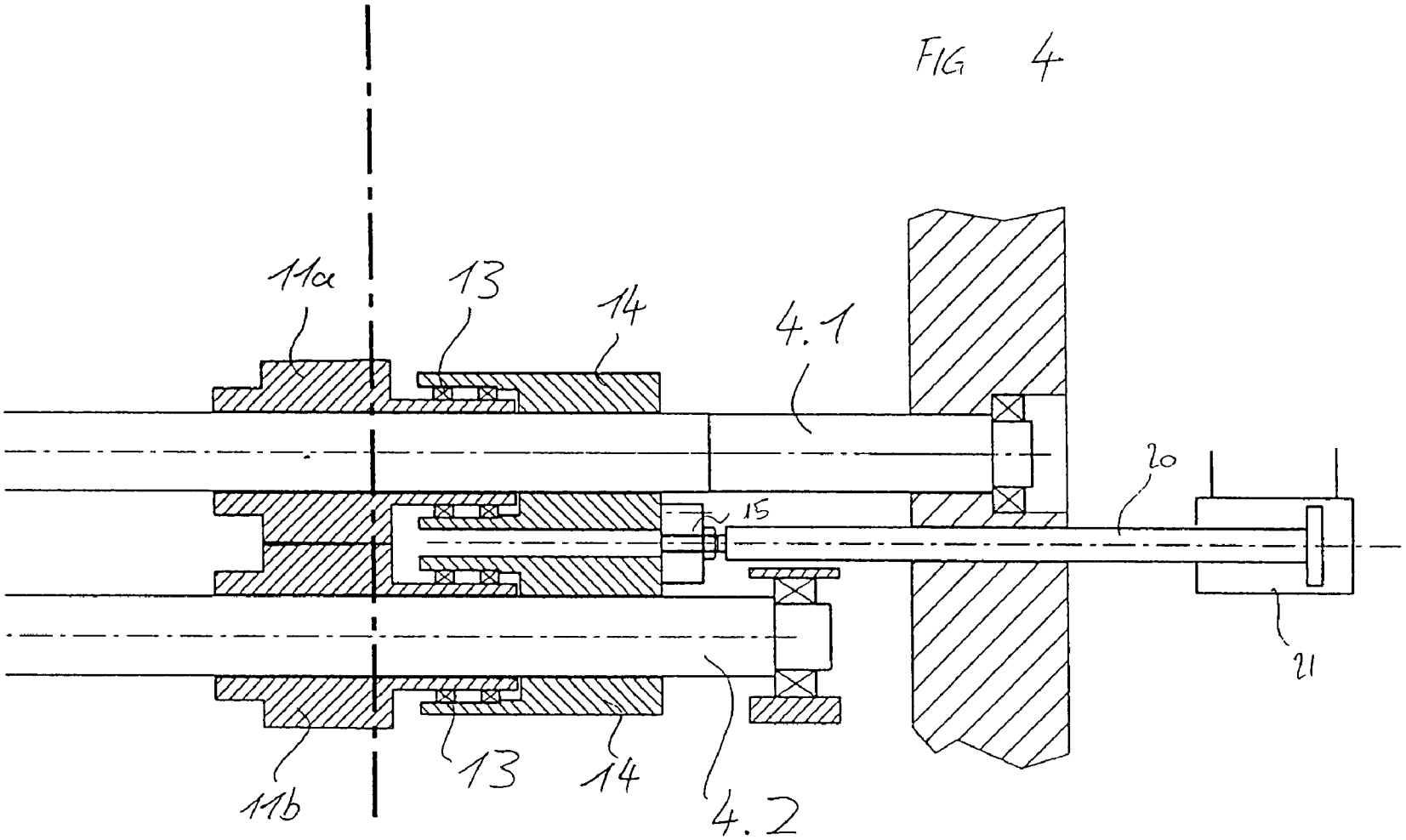
FIG. 4 is a pull ring displaceable on a draw roller by means of a bar.

Instead of a rotatable threaded spindle 16, a bar 20 may also be fastened as an alternative to the threaded sleeve 15, e.g., via a thread or directly, as is shown in FIG. 4. The bar 20 may be coupled, e.g., with a pneumatic piston 21, so that the position of at least one pull ring 11*a* or 11*b* on the draw rollers 4.1 and 4.2 can be displaced by means of the bar 20 by actuating the pneumatic piston 21.

In general, more than the two positions of the pull rings as indicated in the example may also be set with the device according to the present invention, in which cases position recognizing means, i.e., for example, prior-art position sensors, may be advantageously used to measure and, e.g., automatically set the position of a pull ring on a draw roller.

It is also possible, e.g., to adjust one or more pull rings on one or more rollers independently from one another.

Figure 5A:
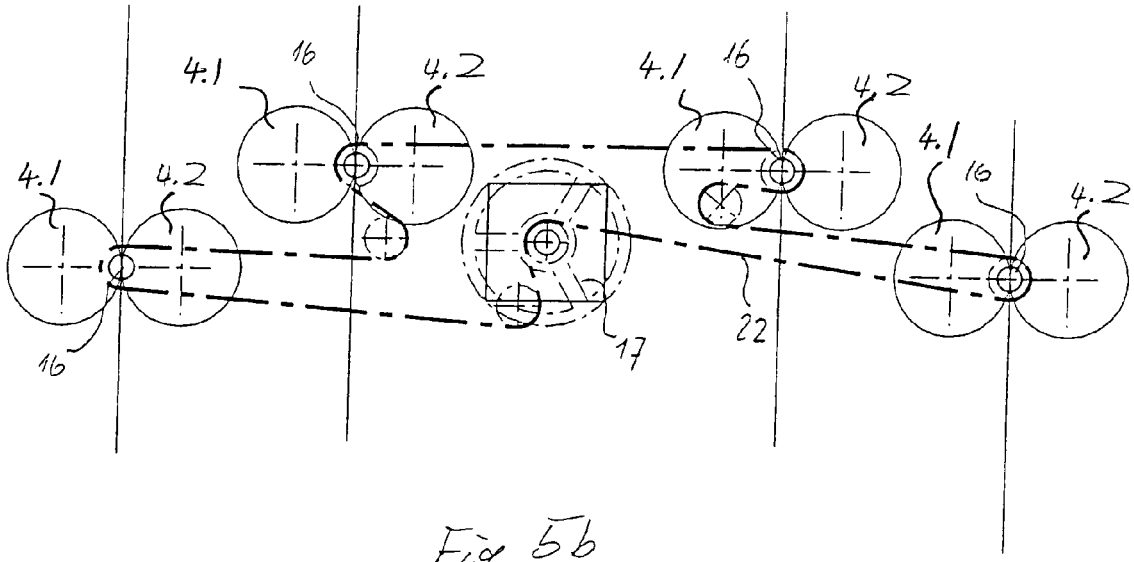
FIG. 5*a* is a device for adjusting the positions of pull rings on a plurality of draw rollers.
Figure 5B:
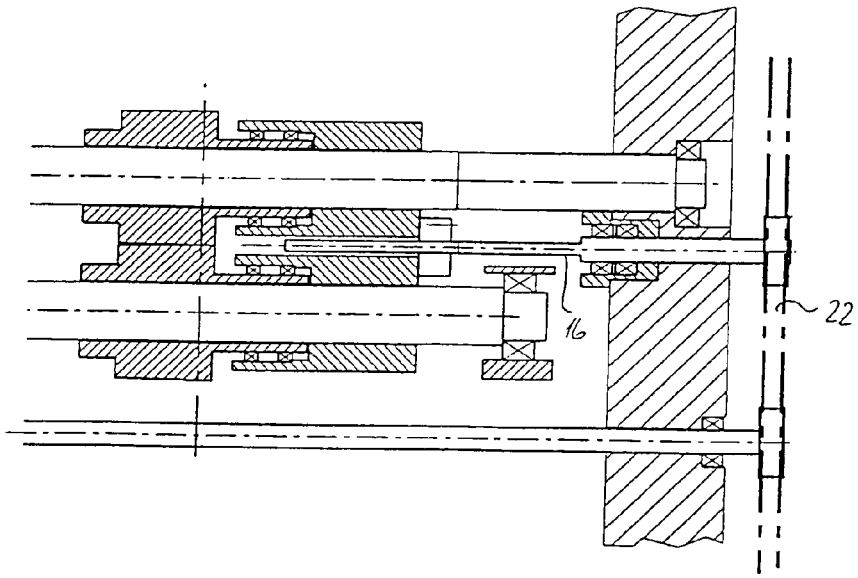
FIG. 5*b* is a top sectional view of the device shown in FIG. 5*a*.

FIGS. 5*a* and 5*b* show an embodiment in which threaded spindles 16 of a plurality of draw rollers can be adjusted together by means of a coupling, e.g., via a toothed belt 22 or a chain via a single drive means 17, e.g., an adjusting motor or a handwheel, so that the design of the device can be simplified and the setting and the operation of a plurality of draw rollers can be synchronized.

While specific embodiments of the invention have been shown and described in detail to illustrate the application of the principles of the invention, it will be understood that the invention may be embodied otherwise without departing from such principles.

What is claimed is:

1. A draw roller arrangement for pulling web-shaped material, the draw roller arrangement comprising:

a draw roller;

a first pull ring arranged on at least one part of the circumference of said draw roller, said at least one pull ring being mounted displaceably on the said draw roller;

a second pull ring arranged on another part of the circumference of said draw roller; and an adjusting device connected to said first pull ring for independently adjusting an axial position of said first pull ring along said draw roller without adjusting a position of said second pull ring along said draw roller, said adjusting device acting from an outer side of said first pull ring, opposite to a side with said second pull ring.

2. A draw roller in accordance with claim 1, wherein said second pull ring is axially positioned at one operative end of said draw roller and a position of said first pull ring defines another operative end of said draw roller, said adjusting device including an axially displaceable sleeve connected to said first pull ring on said outer side of said first pull ring, and transmission means connected to said axially displaceable sleeve from said outer side and for moving said axially displaceable sleeve for moving said first pull ring independently of said second pull ring.

3. A device, comprising:

a draw roller;

a first pull ring arranged on at least one part of the circumference of said draw roller, said at least one pull ring being mounted displaceably on the said draw roller;

a second pull ring arranged on another part of the circumference of said draw roller; another draw roller;

another first pull ring arranged on at least one part of the circumference of said another draw roller, said at least one pull ring being mounted displaceably on the said another draw roller;

another second pull ring arranged on another part of the circumference of said another draw roller;

an adjusting device provided for adjusting a position of each said first pull ring on each said draw roller independently of a position of each said second pull ring on each said draw roller, said adjusting device acting from an outer side of each said first pull ring, opposite to a side with each said second pull ring, each said second pull ring being axially positioned at one operative end of said draw roller wherein a position of each said first pull ring defines another operative end of said draw roller, said adjusting device including an axially displaceable sleeve connected to said first pull ring on said outer side of said first pull ring and another axially displaceable sleeve connected to said another first pull ring on said outer side of said another first pull ring and a transmission and drive means connected to each said axially displaceable sleeve from said outer side and for moving each said axially displaceable sleeve for moving each said first pull ring independently of a position of each said second pull ring.

4. A device in accordance with claim 3, wherein said transmission and drive means has a threaded spindle.

5. A device in accordance with claim 3, wherein said transmission and drive means has a bar.

6. A device in accordance with claim 3, wherein said transmission and drive means has a motor and a electromagnetic, hydraulic or pneumatic device.

7. A printing material pulling draw roller system, comprising:

a first draw roller with a first pull ring mounted axially displaceable along said first draw roller and a second pull ring;

a second draw roller with another first pull ring arranged on at least one part of the circumference of said second draw roller, said another first pull ring being mounted displaceably on the said second draw roller and another second pull ring;

an adjusting device provided for adjusting a position of each said first pull ring on each said draw roller independently of a position of each said second pull ring on each said draw roller, said adjusting device acting from an outer side of each said first pull ring, opposite to a side with each said second pull ring, each said second pull ring being axially positioned at one operative end of said draw roller wherein a position of each said first pull ring defines another operative end of said draw roller, said adjusting device including an axially displaceable sleeve connected to said first pull ring on said outer side of said first pull ring and another axially displaceable sleeve connected to said another first pull ring on said outer side of said another first pull ring and a transmission and drive means connected to each said axially displaceable sleeve from said outer side and for moving each said axially displaceable sleeve for moving each said first pull ring independently of a position of each said second pull ring;

a forming roller for guiding a web of material to be printed; and a former for folding the web to form a web bundle, said former feeding said bundle being fed between said first and second draw rollers.

8. A system in accordance with claim 7, wherein said first draw roller is provided opposite said second draw roller to provide opposite first and second draw roller defining a web bundle guide.

9. A system in accordance with claim 7, wherein said second draw roller is mounted pivotably relative to said first draw roller to adjust a distance between said opposite first and second draw rollers.

10. A process for adjusting a draw roller for pulling web-shaped material to different conditions of use, the process comprising:

providing a draw roller;

providing a first pull ring and a second pull ring arranged on the draw roller;

displacing the first pull ring on the draw roller independently of a position of said second pull ring using an adjusting device acting from an outer side of said first pull ring, with said outer side being on a side of said first pull ring opposite said second pull ring.

11. A process in accordance with claim 10, wherein said adjusting device has a bar.

12. A process in accordance with claim 10, wherein said adjusting device has a bar.

13. A process in accordance with claim 10, wherein said adjusting device has a motor and a electromagnetic, hydraulic or pneumatic device.

14. A process in accordance with claim 10, further comprising providing a second draw roller with another first pull ring arranged on at least one part of the circumference of the second draw roller and another second pull ring arranged with the at least one pull ring being mounted displaceably on said second draw roller and said adjusting device also moves said another first pull ring independently of a position of said another second pull ring using the adjusting device provided for adjusting a position of each said first pull ring on each said draw roller independently of a position of each said second pull ring on each said draw roller, wherein the adjusting device acts from an outer side of each said first pull ring, opposite to a side with each said second pull ring, each said second pull ring being axially positioned at one operative end of said draw roller wherein a position of each said first pull ring defines another operative end of said draw roller, and the adjusting device includes an axially displaceable sleeve connected to said first pull ring on said outer side of said first pull ring and another axially displaceable sleeve connected to said another first pull ring on said outer side of said another first pull ring and using a transmission and drive means connected to each said axially displaceable sleeve from said outer side and for moving each said axially displaceable sleeve for moving each said first pull ring independently of a position of each said second pull ring.

15. A system in accordance with claim 14, wherein the first draw roller is provided opposite the second draw roller defining a web bundle guide and further comprising the steps of:

using a forming roller for guiding a web of material to be printed; and folding the web to with a former to form a bundle;

feeding said bundle from said former to said web bundle guide.

* * * * *